US008851081B2

(12) United States Patent
Fernando et al.

(10) Patent No.: US 8,851,081 B2
(45) **Date of Patent: *Oct. 7, 2014**

(54) ELECTRICALLY HEATED SMOKING SYSTEM

(71) Applicant: Philip Morris USA Inc., Richmond, VA (US)

(72) Inventors: Felix Fernando, Berkshire (GB); Fredrik Stahle, Vevey (CH); Jean-Pierre Cordey, Cheseaux (CH); Laurent Manca, Belmont-sur-Lausanne (CH)

(73) Assignee: Philip Morris USA Inc., Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/841,197

(22) Filed: Mar. 15, 2013

(65) Prior Publication Data

US 2013/0206154 A1 Aug. 15, 2013

Related U.S. Application Data

(63) Continuation of application No. 12/425,622, filed on Apr. 17, 2009, now Pat. No. 8,402,976.

(30) Foreign Application Priority Data

Apr. 17, 2008 (EP) ..... 08251450

(51) Int. Cl.
*A24F 1/22* (2006.01)
*A24F 47/00* (2006.01)

(52) U.S. Cl.
CPC ..... *A24F 47/008* (2013.01); *A24F 47/00* (2013.01)
USPC ..... 131/194

(58) Field of Classification Search
USPC ..... 131/194
See application file for complete search history.

(56) References Cited

U.S. PATENT DOCUMENTS 1,771,366 A 7/1930 Wyss et al.
1,968,509 A 7/1934 Tiffany (Continued)

FOREIGN PATENT DOCUMENTS

CA 1 202 378 3/1986
CN 87/104459 A 2/1988

(Continued)

OTHER PUBLICATIONS

"Microstructure of Alumina Brazed with a Silver-Cooper-Titanium Alloy" by M.L. Santella et al., published in J. Am. Ceram. Soc., 73(6):1785-1787 (1990).

(Continued)

*Primary Examiner* — Richard Crispino
*Assistant Examiner* — Dionne W Mayes
(74) *Attorney, Agent, or Firm* — Buchanan Ingersoll & Rooney PC

(57) ABSTRACT

An electrically heated smoking system for receiving an aerosol-forming substrate. includes at least one heating element for heating the substrate to form an aerosol, a power supply for supplying power to the heating element, electrical hardware connected to the power supply and the heating element, and an interface for establishing a communications link with a host. The communications link may be a USB link and the host may be a personal computer.

8 Claims, 2 Drawing Sheets

(56) References Cited

U.S. PATENT DOCUMENTS

| | | | |
|---|---|---|---|
| 2,057,353 | A | 10/1936 | Whittemore, Jr. |
| 2,104,266 | A | 1/1938 | McCormick |
| 2,406,275 | A | 8/1946 | Wejnarth |
| 2,442,004 | A | 5/1948 | Hayward-Butt |
| 2,971,039 | A | 2/1961 | Western |
| 2,974,669 | A | 3/1961 | Ellis |
| 3,200,819 | A | 8/1965 | Gilbert |
| 3,255,760 | A | 6/1966 | Selker |
| 3,258,015 | A | 6/1966 | Ellis et al. |
| 3,280,819 | A | 10/1966 | Weeks |
| 3,363,633 | A | 1/1968 | Weber |
| 3,402,723 | A | 9/1968 | Hu |
| 3,443,049 | A | 5/1969 | Hoagland |
| 3,482,580 | A | 12/1969 | Hollabaugh |
| 3,608,560 | A | 9/1971 | Briskin et al. |
| 3,738,374 | A | 6/1973 | Bennett |
| 3,744,496 | A | 7/1973 | McCarty et al. |
| 3,804,100 | A | 4/1974 | Fariello |
| 3,875,476 | A | 4/1975 | Crandall et al. |
| 3,889,690 | A | 6/1975 | Guarnieri |
| 3,895,219 | A | 7/1975 | Richerson et al. |
| 3,976,529 | A | 8/1976 | Weicjselbaum |
| 4,016,061 | A | 4/1977 | Wasa et al. |
| 4,068,672 | A | 1/1978 | Guerra |
| 4,077,784 | A | 3/1978 | Vayrynen |
| 4,098,725 | A | 7/1978 | Yamamoto et al. |
| 4,103,144 | A | 7/1978 | Pizzarello |
| 4,110,260 | A | 8/1978 | Yamamoto et al. |
| 4,131,119 | A | 12/1978 | Blasutti |
| 4,141,369 | A | 2/1979 | Burruss |
| 4,164,230 | A | 8/1979 | Pearlman |
| 4,193,411 | A | 3/1980 | Faris et al. |
| 4,215,708 | A | 8/1980 | Bron |
| 4,219,032 | A | 8/1980 | Tabatznik et al. |
| 4,246,913 | A | 1/1981 | Ogden et al. |
| 4,256,945 | A | 3/1981 | Carter et al. |
| 4,259,970 | A | 4/1981 | Green, Jr. |
| 4,303,083 | A | 12/1981 | Burruss, Jr. |
| 4,319,591 | A | 3/1982 | Keith et al. |
| 4,327,186 | A | 4/1982 | Murata et al. |
| 4,355,222 | A | 10/1982 | Geithman et al. |
| 4,393,884 | A | 7/1983 | Jacobs |
| 4,407,971 | A | 10/1983 | Komatsu et al. |
| 4,416,840 | A | 11/1983 | Lee et al. |
| 4,431,903 | A | 2/1984 | Riccio |
| 4,436,100 | A | 3/1984 | Green, Jr. |
| 4,449,039 | A | 5/1984 | Fukazawa et al. |
| 4,463,247 | A | 7/1984 | Lawrence et al. |
| 4,467,165 | A | 8/1984 | Kiuchi |
| 4,475,029 | A | 10/1984 | Yoshida et al. |
| 4,488,335 | A | 12/1984 | Fox |
| 4,503,319 | A | 3/1985 | Moritoki et al. |
| 4,505,282 | A | 3/1985 | Cogbill et al. |
| 4,521,659 | A | 6/1985 | Buckley |
| 4,528,121 | A | 7/1985 | Matsushita et al. |
| 4,549,905 | A | 10/1985 | Yamaguchi et al. |
| 4,555,358 | A | 11/1985 | Matsushita et al. |
| 4,562,337 | A | 12/1985 | Lawrence |
| 4,570,646 | A | 2/1986 | Herron |
| 4,572,216 | A | 2/1986 | Josuttis et al. |
| 4,580,583 | A | 4/1986 | Greent, Jr. |
| 4,621,649 | A | 11/1986 | Osterrath |
| 4,623,401 | A | 11/1986 | Derbyshire et al. |
| 4,634,837 | A | 1/1987 | Ito et al. |
| 4,637,407 | A | 1/1987 | Bonanno et al. |
| 4,659,912 | A | 4/1987 | Derbyshire |
| 4,714,082 | A | 12/1987 | Banerjee et al. |
| 4,735,217 | A | 4/1988 | Gerth et al. |
| 4,765,859 | A | 8/1988 | Health et al. |
| 4,771,796 | A | 9/1988 | Myer |
| 4,776,353 | A | 10/1988 | Lilja et al. |
| 4,789,767 | A | 12/1988 | Doljack |
| 4,837,421 | A | 6/1989 | Luthy |
| 4,846,199 | A | 7/1989 | Rose |
| 4,848,376 | A | 7/1989 | Lilja et al. |
| 4,874,924 | A | 10/1989 | Yamamoto et al. |
| 4,877,989 | A | 10/1989 | Drews et al. |
| 4,922,901 | A | 5/1990 | Brooks et al. |
| 4,945,931 | A | 8/1990 | Gori |
| 4,947,874 | A | 8/1990 | Brooks et al. |
| 4,947,875 | A | 8/1990 | Brooks et al. |
| 4,966,171 | A | 10/1990 | Serrano et al. |
| 4,981,522 | A | 1/1991 | Nichols et al. |
| 4,991,606 | A | 2/1991 | Serrano et al. |
| 5,016,656 | A | 5/1991 | McMurtrie |
| 5,040,551 | A | 8/1991 | Schlatter et al. |
| 5,040,552 | A | 8/1991 | Schleich et al. |
| 5,042,510 | A | 8/1991 | Curtiss et al. |
| 5,045,237 | A | 9/1991 | Washburn |
| 5,060,671 | A | 10/1991 | Counts et al. |
| 5,075,529 | A | 12/1991 | Kudo |
| 5,076,296 | A | 12/1991 | Nystrom et al. |
| 5,080,115 | A | 1/1992 | Templeton |
| 5,085,804 | A | 2/1992 | Washburn |
| 5,093,894 | A | 3/1992 | Deevi et al. |
| 5,095,921 | A | 3/1992 | Losee et al. |
| 5,101,086 | A | 3/1992 | Dion et al. |
| 5,139,594 | A | 8/1992 | Rabin |
| 5,144,962 | A | 9/1992 | Counts et al. |
| 5,157,242 | A | 10/1992 | Hetherington et al. |
| 5,159,940 | A | 11/1992 | Hayward et al. |
| 5,179,966 | A | 1/1993 | Losee et al. |
| 5,188,130 | A | 2/1993 | Hajaligol |
| 5,224,498 | A | 7/1993 | Deevi et al. |
| 5,228,460 | A | 7/1993 | Sprinkel et al. |
| 5,235,157 | A | 8/1993 | Blackburn |
| 5,236,108 | A | 8/1993 | House |
| 5,249,586 | A | 10/1993 | Morgan et al. |
| 5,261,424 | A | 11/1993 | Sprinkel, Jr. |
| 5,268,553 | A | 12/1993 | Shimoji |
| 5,269,327 | A | 12/1993 | Counts et al. |
| 5,274,214 | A | 12/1993 | Blackburn |
| 5,285,050 | A | 2/1994 | Blackburn |
| 5,322,075 | A | 6/1994 | Deevi et al. |
| 5,353,813 | A | 10/1994 | Deevi et al. |
| 5,369,723 | A | 11/1994 | Counts et al. |
| 5,372,148 | A | 12/1994 | McCafferty et al. |
| 5,388,574 | A | 2/1995 | Ingebrethsen |
| 5,388,594 | A | 2/1995 | Counts et al. |
| 5,396,911 | A | 3/1995 | Casey, III et al. |
| 5,408,574 | A | 4/1995 | Deevi et al. |
| 5,469,871 | A | 11/1995 | Barnes et al. |
| 5,479,948 | A | 1/1996 | Counts et al. |
| 5,498,855 | A | 3/1996 | Deevi et al. |
| 5,499,636 | A | 3/1996 | Baggett et al. |
| 5,505,214 | A | 4/1996 | Collins et al. |
| 5,514,630 | A | 5/1996 | Willkens et al. |
| 5,530,225 | A | 6/1996 | Hajaligol |
| 5,591,368 | A | 1/1997 | Fleischhauer et al. |
| 5,613,504 | A | 3/1997 | Collins et al. |
| 5,613,505 | A | 3/1997 | Campbell et al. |
| 5,665,262 | A | 9/1997 | Hajaligol |
| 5,666,977 | A | 9/1997 | Higgins et al. |
| 5,666,978 | A | 9/1997 | Counts et al. |
| 5,708,258 | A | 1/1998 | Counts et al. |
| 5,750,964 | A | 5/1998 | Counts et al. |
| 5,819,751 | A | 10/1998 | Barnes et al. |
| 5,819,756 | A | 10/1998 | Mielordt |
| 5,934,289 | A | 8/1999 | Watkins et al. |
| 6,040,560 | A | 3/2000 | Fleischhauer et al. |
| 6,155,268 | A | 12/2000 | Takeuchi |
| 6,196,218 | B1 | 3/2001 | Voges |
| 6,446,426 | B1 | 9/2002 | Sweeney et al. |
| 6,598,607 | B2 | 7/2003 | Adiga et al. |
| 6,615,840 | B1 | 9/2003 | Fournier et al. |
| 6,688,313 | B2 | 2/2004 | Wrenn et al. |
| 6,772,756 | B2 | 8/2004 | Shayan |
| 6,803,545 | B2 | 10/2004 | Blake et al. |
| 6,810,883 | B2 | 11/2004 | Felter et al. |
| 6,854,470 | B1 | 2/2005 | Pu |
| 7,131,599 | B2 | 11/2006 | Katase |
| 7,293,565 | B2 | 11/2007 | Griffin et al. |
| 7,458,374 | B2 | 12/2008 | Hale et al. |
| 7,690,385 | B2 | 4/2010 | Moffitt |

(56) References Cited

U.S. PATENT DOCUMENTS

| | | | | |
|---|---|---|---|---|
| 7,726,320 | B2 | 6/2010 | Robinson et al. | |
| 7,832,410 | B2 | 11/2010 | Hon | |
| 7,845,359 | B2 | 12/2010 | Montaser | |
| 7,997,280 | B2 | 8/2011 | Rosenthal | |
| 8,079,371 | B2 | 12/2011 | Robinson et al. | |
| 8,127,772 | B2 | 3/2012 | Montaser | |
| 8,156,944 | B2 | 4/2012 | Han | |
| 8,402,976 | B2 * | 3/2013 | Fernando et al. | 131/194 |
| 2002/0119873 | A1 | 8/2002 | Heitmann | |
| 2003/0070555 | A1 | 4/2003 | Reyhanloo | |
| 2004/0200488 | A1 | 10/2004 | Felter et al. | |
| 2005/0016550 | A1 | 1/2005 | Katase | |
| 2006/0112963 | A1 | 6/2006 | Scott et al. | |
| 2006/0118128 | A1 | 6/2006 | Hoffmann et al. | |
| 2006/0130860 | A1 | 6/2006 | Cholet | |
| 2006/0196518 | A1 | 9/2006 | Hon | |
| 2007/0074734 | A1 | 4/2007 | Braunshteyn et al. | |
| 2007/0102013 | A1 | 5/2007 | Adams et al. | |
| 2008/0230052 | A1 | 9/2008 | Montaser | |
| 2008/0276947 | A1 | 11/2008 | Martzel | |
| 2009/0126745 | A1 | 5/2009 | Hon | |
| 2009/0151717 | A1 | 6/2009 | Bowen et al. | |
| 2009/0188490 | A1 | 7/2009 | Han | |
| 2009/0230117 | A1 | 9/2009 | Fernando et al. | |
| 2009/0272379 | A1 | 11/2009 | Thorens et al. | |
| 2010/0090644 | A1 | 4/2010 | Nokkonen et al. | |
| 2010/0163063 | A1 | 7/2010 | Fernando et al. | |
| 2010/0307518 | A1 | 12/2010 | Wang | |
| 2010/0313901 | A1 | 12/2010 | Fernando et al. | |
| 2011/0094523 | A1 | 4/2011 | Thorens et al. | |
| 2011/0120482 | A1 | 5/2011 | Brenneise | |
| 2011/0126848 | A1 | 6/2011 | Zuber et al. | |
| 2011/0147486 | A1 | 6/2011 | Greim et al. | |
| 2011/0155151 | A1 | 6/2011 | Newman et al. | |
| 2011/0155153 | A1 | 6/2011 | Thorens et al. | |
| 2011/0155718 | A1 | 6/2011 | Greim et al. | |
| 2011/0168194 | A1 | 7/2011 | Hon | |
| 2011/0209717 | A1 | 9/2011 | Han | |
| 2011/0309157 | A1 | 12/2011 | Yang et al. | |
| 2012/0090630 | A1 | 4/2012 | Hon | |

FOREIGN PATENT DOCUMENTS

| | | | |
|---|---|---|---|
| CN | 1 060 598 | A | 4/1992 |
| CN | 1530041 | A | 9/2004 |
| CN | 1541577 | A | 11/2004 |
| CN | 2719043 | Y | 8/2005 |
| CN | 201067079 | | 6/2006 |
| CN | 200966824 | | 10/2007 |
| DE | 2 911 565 | | 9/1980 |
| DE | 3 038 069 | A1 | 4/1982 |
| DE | 243 784 | A1 | 11/1987 |
| DE | 3 640 917 | A1 | 8/1988 |
| DE | 3 711 234 | | 10/1988 |
| DE | 3 735 704 | A1 | 5/1989 |
| DE | 301 092 | A7 | 1/1992 |
| EP | 0 438 862 | | 7/1982 |
| EP | 0 239 802 | A2 | 10/1987 |
| EP | 0 277 519 | A2 | 8/1988 |
| EP | 0 295 122 | A2 | 12/1988 |
| EP | 0 358 002 | A2 | 3/1990 |
| EP | 0 358 114 | | 3/1990 |
| EP | 0 378 997 | | 4/1990 |
| EP | 0 430 566 | | 6/1991 |
| EP | 0 449 790 | A2 | 10/1991 |
| EP | 0 640 297 | A | 1/1995 |
| EP | 0 857 431 | A1 | 8/1998 |
| EP | 0 893 071 | A1 | 1/1999 |
| EP | 1 226 765 | A2 | 7/2002 |
| EP | 1 559 332 | A1 | 8/2005 |
| EP | 1 618 803 | A1 | 1/2006 |
| EP | 1 736 062 | A2 | 12/2006 |
| EP | 1 736 065 | A1 | 12/2006 |
| GB | 1 298 808 | | 12/1972 |
| GB | 2 132 539 | | 7/1984 |
| GB | 2 148 079 | | 5/1985 |
| GB | 2 148 676 | | 5/1985 |
| JP | 45-28471 | | 9/1970 |
| JP | 61-68061 | | 4/1986 |
| JP | 64-17386 | | 1/1989 |
| JP | 2-98301 | | 4/1990 |
| JP | 2-263773 | | 10/1990 |
| JP | 2006-320286 | A | 11/2006 |
| KR | 100636287 | B1 | 10/2006 |
| SU | 621141 | | 8/1978 |
| SU | 864597 | | 9/1981 |
| WO | WO 86/02528 | | 4/1986 |
| WO | WO 94/06313 | | 3/1994 |
| WO | WO 94/06314 | | 3/1994 |
| WO | WO 95/02970 | | 2/1995 |
| WO | WO 95/27411 | | 10/1995 |
| WO | WO 00/28843 | A1 | 3/2000 |
| WO | WO 03/095688 | A2 | 11/2003 |
| WO | WO 2004/043175 | A1 | 5/2004 |
| WO | WO2004/080216 | | 9/2004 |
| WO | WO2004/095955 | | 11/2004 |
| WO | WO2005/099494 | | 10/2005 |
| WO | WO 2007/066374 | A1 | 6/2007 |
| WO | WO 2007/066167 | A1 | 7/2007 |
| WO | WO 2007/078273 | A1 | 7/2007 |
| WO | WO 2007/131449 | A1 | 11/2007 |
| WO | WO 2007/131450 | A1 | 11/2007 |
| WO | WO 2008/015441 | A1 | 2/2008 |
| WO | WO2008/055423 | | 5/2008 |
| WO | WO2010/091593 | | 8/2010 |

OTHER PUBLICATIONS

Fen et al., "Cyclic oxidation of Haynes 230 alloy", Chapman & Hall, pp. 1514-1520 (1992).

Kutner, "Thermal spray by design", Reprint from Advanced Materials & Processes Incorporating Metal Progress, Oct. 1988.

"Characterizing Thermal Spray Coatings", Article based on presentation made at the Fourth National Thermal Spray Conference, May 4-10, 1991 and appearing in Advanced Materials and Processes, May 1992, pp. 23-27.

Howes, Jr., "Computerized Plasma Control for Applying Medical-Quality Coatings", Industrial Heaing, pp. 22-25, Aug. 1993.

V. Sikka, "Processing of Intermetallic Aluminides", Intermetallic Metallurgy and Processing Intermetallic Compounds, ed Stoloff et al., Van Mestrand Reinhold, N.Y., 1994.

Brezovich, "Temperature Distributions in Tumor Models Heater," Mar./Apr. 1984, pp. 145-152.

Gorbachev, "Compensation of Varying Load in a Thyristor," v. 56, No. 3, pp. 27-28.

Katagiri, "Rapid Reinforcement for Fusion Mass spliced Fibers using Low-Power," Jun. 1, 1985, pp. 1708-1712.

Matthes, "Thyristorised Conerters for Inductive Heating for Hot Forging," 1975, pp. 80-86.

Stauffer, "Observations on the Use of Ferromagnetic" 1984, pp. 76-90.

Reinshagen and Sikka, "Thermal Spraying of Selected Aluminides", Proceedings of the Fourth National Thermal Spray Conference, Pittsburgh, PA USA, pp. 307-313 (May 4-10, 1991).

Duarante, "A Design Procedure for a Self Oscillating Hybrid Inverter," 1991, pp. 350-355.

Xu, "The High-Frequency Inductive Electric Heater and Its Application," Apr. 1992, pp. 39-42.

"Joining of Ceramics" by R.E. Loehman et al., published in Ceramic Bulletin, 67(d); 375-380 (1988).

Oxidation Behavior of Silver--and Copper-Based Brazing Filler Metals for Silicon Nitride/Metal Joints by R.R. Kapoor et al., published in J. Am. Ceram. Soc., 72(3):448-454 (1989).

"Brazing Ceramic Oxides to Metals at Low Temperatures" by J.P. Hammond et al., published in Welding Research Supplement, 227-232-s, (1988).

"Brazing of Titanium-Vapor-Coated Silicon Nitride" by M. L. Santella, published in Advanced Ceramic Materials, 3(5):457-465 (1988).

* cited by examiner

ELECTRICALLY HEATED SMOKING SYSTEM

CROSS-REFERENCE TO RELATED APPLICATION

This application is a continuation under 35 U.S.C. §120 of U.S. patent application Ser. No. 12/425,622 filed on Apr. 17, 2009, and claiming priority under 35 U.S.C. §119 to European Patent Application No. 0 825 1450, filed Apr. 17, 2008, the entire contents of which are incorporated herein by this reference thereto.

BACKGROUND

The present invention relates generally to an electrically heated smoking system for receiving an aerosol-forming substrate.

A number of prior art documents, for example U.S. Pat. No. 5,060,671 (commonly owned, the entire contents of which are included herein by this reference thereto), U.S. Pat. No. 5,388,594 (commonly owned, the entire contents of which are included herein by this reference thereto), U.S. Pat. No. 5,505,214 (commonly owned, the entire contents of which are included herein by this reference thereto), U.S. Pat. No. 5,591,368 (commonly owned, the entire contents of which are included herein by this reference thereto), WO2004/043175, EP 0 358 002, EP 0 295 122, EP 1 618 803, EP 1 736 065 and WO2007/131449, disclose electrically operated smoking systems, having a number of advantages. One advantage is that electrically operated smoking systems significantly reduce sidestream smoke, while permitting the smoker to selectively suspend and reinitiate smoking.

Prior art documents, such as EP 0 295 122, EP 1 618 803 and EP 1 736 065, disclose electrical smoking systems which use a liquid as the aerosol-forming substrate. The liquid may be contained in a cartridge which is receivable in a housing. A power supply, such as a battery, is provided, connected to a heater to heat the liquid substrate during a puff, to form the aerosol which is provided to the smoker.

The electrically heated smoking systems of the prior art, including those described above, typically provide a high power pulse to the heater to provide the temperature range desired for operation and to release the volatile compounds for each puff.

The electrically heated smoking systems of the prior art, including those described above, have certain advantages, but there is still room for improvement. It is therefore an object of the invention to provide an improved electrically heated smoking system which offers additional functionality to the smoker.

SUMMARY OF CERTAIN ASPECTS OF THE INVENTION

According to a first aspect of the invention there is provided an electrically heated smoking system for receiving an aerosol-forming substrate, the system comprising: at least one heating element for heating the substrate to form an aerosol; a power supply for supplying power to the at least one heating element; electrical hardware connected to the power supply and the at least one heating element; and an interface for establishing a communications link with a host.

By providing an interface for establishing a communications link with a host, the electrical hardware in the system itself can be relatively simple in terms of memory and processing power. This allows the electrically heated smoking system to remain relatively low cost to manufacture. The interface for establishing the communications link with the host allows interaction between the system and the host. Thus, extended features can be implemented via the host at the same time as keeping the hardware in the system itself relatively simple.

The aerosol-forming substrate preferably comprises a tobacco-containing material containing volatile tobacco flavour compounds which are released from the substrate upon heating. Alternatively, the aerosol-forming substrate may comprise a non-tobacco material.

Preferably, the aerosol-forming substrate further comprises an aerosol former. Examples of suitable aerosol formers are glycerine and propylene glycol. Additional examples of potentially suitable aerosol formers are described in EP 0 277 519 and U.S. Pat. No. 5,396,911.

The aerosol-forming substrate may be a solid substrate. The solid substrate may comprise, for example, one or more of: powder, granules, pellets, shreds, spaghettis, strips or sheets, where such powder, granules, pellets, shreds, spaghettis, strips or sheets may further contain one or more of: herb leaf, tobacco leaf, fragments of tobacco ribs, reconstituted tobacco, homogenized tobacco, extruded tobacco, and expanded tobacco. The solid substrate may be in loose form, or may be provided in a suitable container or cartridge, such as, for example, shredded tobacco contained by a suitable wrapper. Optionally, the solid substrate may contain additional tobacco or non-tobacco volatile flavour compounds, to be released upon heating of the substrate.

Optionally, the solid substrate may be provided on or embedded in a thermally stable carrier. The carrier may take the form of powder, granules, pellets, shreds, spaghettis, strips or sheets. Alternatively, the carrier may be a tubular carrier having a thin layer of the solid substrate deposited on its inner surface, such as those disclosed in U.S. Pat. No. 5,505,214, U.S. Pat. No. 5,591,368 and U.S. Pat. No. 5,388,594, or on its outer surface, or on both its inner and outer surfaces. Such a tubular carrier may be formed of, for example, a paper, or paper like material, a non-woven carbon fiber mat, a low mass open mesh metallic screen, or a perforated metallic foil or any other thermally stable polymer matrix.

The solid substrate may be deposited on the surface of the carrier in the form of, for example, a sheet, foam, gel or slurry. The solid substrate may be deposited on the entire surface of the carrier, or alternatively, may be deposited in a pattern in order to provide a non-uniform flavour delivery during use.

Alternatively, the carrier may be a non-woven fabric or fiber bundle into which tobacco components have been incorporated, such as that described in EP 0 857 431. The non-woven fabric or fiber bundle may comprise, for example, carbon fibers, natural cellulose fibers, or cellulose derivative fibers.

Alternatively, the carrier may be at least a part of the heating element of the electrically heated smoking system. In such cases, the heating element is typically disposable. For example, the solid substrate may be deposited as a thin layer on a metallic foil or on an electrically resistive support as described in U.S. Pat. No. 5,060,671.

The aerosol-forming substrate may be a liquid substrate. If a liquid substrate is provided, the electrically heated smoking system preferably comprises means for retaining the liquid. For example, the liquid substrate may be retained in a container, such as that described in EP 0 893 071. Alternatively or in addition, the liquid substrate may be absorbed into a porous carrier material, as described in WO2007/066374, EP 1 736 062, WO2007/131449 and WO2007/131450. The porous carrier material may be made from any suitable absorbent plug or body, for example, a foamed metal or plastics material, polypropylene, terylene, nylon fibers or ceramic. The liquid substrate may be retained in the porous carrier material prior to use of the electrically heated smoking system or alternatively, the liquid substrate material may be released into the porous carrier material during, or immediately prior to use. For example, the liquid substrate may be provided in a capsule, as described in WO2007/077167. The shell of the capsule preferably melts upon heating and releases the liquid substrate into the porous carrier material. The capsule may optionally contain a solid in combination with the liquid.

If the aerosol-forming substrate is a liquid substrate, the electrically heated smoking system may further comprise means for heating a small amount of liquid at a time. The means for heating a small amount of liquid at a time may include, for example, a liquid passageway in communication with the liquid substrate, as described in EP 0 893 071. The liquid substrate is typically forced into the liquid passageway by capillary force. The heating element is preferably arranged such that, during use, only the small amount of liquid substrate within the liquid passageway, and not the liquid within the container, is heated and volatilized.

Alternatively, or in addition, if the aerosol-forming substrate is a liquid substrate, the electrically heated smoking system may further comprise an atomizer in contact with the liquid substrate source and including the at least one heating element. In addition to the heating element, the atomizer may include one or more electromechanical elements such as piezoelectric elements. Additionally or alternatively, the atomizer may also include elements that use electrostatic, electromagnetic or pneumatic effects. The electrically heated smoking system may still further comprise a condensation chamber.

The aerosol-forming substrate may alternatively be any other sort of substrate, for example, a gas substrate, or any combination of the various types of substrate. During operation, the substrate may be completely contained within the electrically heated smoking system. In that case, a user may puff on a mouthpiece of the electrically heated smoking system. Alternatively, during operation, the substrate may be partially contained within the electrically heated smoking system. In that case, the substrate may form part of a separate article and the user may puff directly on the separate article.

The at least one heating element may comprise a single heating element. Alternatively, the at least one heating element may comprise more than one heating element. The heating element or heating elements may be arranged appropriately so as to most effectively heat the aerosol-forming substrate.

The at least one heating element preferably comprises an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel, Timetal® and iron-manganese-aluminium based alloys. In composite materials, the electrically resistive material may optionally be embedded in, encapsulated or coated with an insulating material or vice-versa, depending on the kinetics of energy transfer and the external physicochemical properties required. Examples of suitable composite heating elements are disclosed in U.S. Pat. No. 5,498,855 (commonly owned, the entire contents of which are included herein by this reference thereto), WO03/095688 and U.S. Pat. No. 5,514,630.

Alternatively, the at least one heating element may comprise an infra-red heating element, a photonic source such as, for example, those described in U.S. Pat. No. 5,934,289 (commonly owned, the entire contents of which are included herein by this reference thereto), or an inductive heating element, such as, for example, those described in U.S. Pat. No. 5,613,505 (commonly owned, the entire contents of which are included herein by this reference thereto).

The at least one heating element may take any suitable form. For example, the at least one heating element may take the form of a heating blade, such as those described in U.S. Pat. No. 5,388,594, U.S. Pat. No. 5,591,368 and U.S. Pat. No. 5,505,214. Alternatively, the at least one heating element may take the form of a casing or substrate having different electro-conductive portions, as described in EP 1 128 741, or an electrically resistive metallic tube, as described in WO2007/066374. Where the aerosol-forming substrate is a liquid provided within a container, the container may incorporate a disposable heating element. Alternatively, one or more heating needles or rods that run through the centre of the aerosol-forming substrate, as described in KR 100636287 and JP 2006320286, may also be suitable. Alternatively, the at least one heating element may be a disk (end) heater or a combination of a disk heater with heating needles or rods. Other alternatives include a heating wire or filament, for example a Ni—Cr, platinum, tungsten or alloy wire, such as those described in EP 1 736 065, or a heating plate. Optionally, the heating element may be deposited in or on a rigid carrier material.

The at least one heating element may comprise a heat sink, or heat reservoir comprising a material capable of absorbing and storing heat and subsequently releasing the heat over time to the aerosol-forming substrate. Suitable heat sinks are described in EP 0 857 431, US 2006/118128 and WO2008/015441. The heat sink may be formed of any suitable material, such as a suitable metal or ceramic material. Preferably, the material has a high heat capacity (sensible heat storage material), or is a material capable of absorbing and subsequently releasing heat via a reversible process, such as a high temperature phase change. Suitable sensible heat storage materials include silica gel, alumina, carbon, glass mat, glass fiber, minerals, a metal or alloy such as aluminium, silver or lead, and a cellulose material such as paper. Other suitable materials which release heat via a reversible phase change include paraffin, sodium acetate, naphthalene, wax, polyethylene oxide, a metal, metal salt, a mixture of eutectic salts or an alloy.

The heat sink or heat reservoir may be arranged such that it is directly in contact with the aerosol-forming substrate and can transfer the stored heat directly to the substrate, as described in EP 0 857 431. Alternatively, the heat stored in the heat sink or heat reservoir may be transferred to the aerosol-forming substrate by means of a heat conductor, such as a metallic tube, as described in WO2008/015441.

The at least one heating element may heat the aerosol-forming substrate by means of conduction. The heating element may be at least partially in contact with the substrate, or the carrier on which the substrate is deposited. Alternatively, the heat from the heating element may be conducted to the substrate by means of a heat conductive element.

Alternatively, the at least one heating element may transfer heat to the incoming ambient air that is drawn through the electrically heated smoking system during use, which in turn heats the aerosol-forming substrate by convection. The ambient air may be heated before passing through the aerosol-forming substrate, as described in WO2007/066374. Alternatively, if the aerosol-forming substrate is a liquid substrate, the ambient air may be first drawn through the substrate and then heated, as described in WO2007/078273.

In a first embodiment, the power supply for supplying power to the at least one heating element comprises a power cell contained in the electrically heated smoking system. In that case, the power supply may be a Lithium-ion battery or one of its variants, for example, a Lithium-ion polymer battery. Alternatively, the power supply may be a Nickel-metal hydride battery or a Nickel cadmium battery or a fuel cell. In that case, preferably, the electrically heated smoking system is usable by a smoker until the energy in the power cell is used up. Preferably, the power cell is entirely self-contained within the electrically heated smoking system.

In a second embodiment, the power supply for supplying power to the at least one heating element comprises circuitry chargeable by an external charging portion. The external charging portion may form part of the electrically heated smoking system. For example, the electrically heated smoking system may comprise a portion to be held by a user, and the external charging portion. The external charging portion may take the form of a docking station. Or, the external charging portion may form part of the host. In that case, the circuitry may be charged by connection of the electrically heated smoking system with the host via the communications link. In the second embodiment, preferably the circuitry, when charged, provides power for a pre-determined number of puffs, after which the circuitry must be reconnected to the external charging portion. An example of suitable circuitry is one or more capacitors or re-chargeable batteries.

In a third embodiment, the power supply for supplying power to the at least one heating element comprises an interface for connection to an external power source. Preferably, the interface is connected to the external power source at all times during use. In the third embodiment, the interface will preferably need to be connected to the external power source whenever a smoker wishes to use the system, since there is preferably no power source in the system itself. In the third embodiment, the interface may be connected to the external power source by connection of the electrically heated smoking system with the host via the communications link. That is, power may be supplied to the interface from the host, via the communications link.

Thus, in the context of the invention, the term "power supply" should be inferred to mean either a self-contained power cell, or chargeable circuitry, or an interface for connection to an external source or a combination of two or more of these.

The communications link may be a wireless communications link. Alternatively, the communications link may be a wired communications link. The communications link may be suitable for flow of data from the electrically heated smoking system to the host. The communications link may be suitable for flow of data from the host to the electrically heated smoking system. Preferably, the communications link is suitable for bi-directional flow of data, from the electrically heated smoking system to the host and from the host to the electrically heated smoking system. Preferably, the communications link is suitable for providing electrical power from the host to the electrically heated smoking system.

Preferably, the communications link operates under an interface standard. An interface standard is a standard that describes one or more functional characteristics, such as code conversion, line assignments, or protocol compliance, or physical characteristics, such as electrical, mechanical, or optical characteristics, necessary to allow the exchange of information between two or more systems or pieces of equipment. Examples of suitable interface standards for the communications link include, but are not limited to, the Recommended Standard 232 (RS-232) family of standards; Universal Serial Bus (USB); Bluetooth; FireWire (a brand name of Apple, Inc for their IEEE 1394 interface), IrDA (Infrared Data Association—a communications standard for the short-range exchange of data by Infrared light); Zigbee (a specification based on the IEEE 802.15.4 standard for wireless personal area networks) and other Wi-Fi standards.

In a preferred embodiment, the communications link is a Universal Serial Bus—USB—link. This is advantageous because a USB communications link provides bi-directional communication and also a power link (usually 5 V).

Preferably, the host is Internet-enabled. That is, preferably the host is able to connect to one or more Internet sites in order to upload data or download data or both upload and download data. This allows extended features to be implemented from the Internet via the host, at the same time as keeping the hardware in the system itself relatively simple. Throughout the specification, in the context of the present invention, the term "Internet" is used to refer to the worldwide, publicly accessible series of interconnected computer networks that transmit data using the standard Internet Protocol (IP). It includes the World Wide Web (www) but also includes other domestic, academic, business, government and other networks outside the World Wide Web.

The host may be a personal computer. The personal computer may be a desktop computer. The personal computer may be a laptop computer or a notebook computer. The personal computer may be a tablet computer such as a Personal Digital Assistant (PDA), a Personal Information Device (PID), a Portable Media Player (PMP, such as an Apple, Inc iPod®) or a Portable Video Player (PVP). The host may be a mobile cellular telephone.

The interface is an interface suitable for the particular communications link. For example, in the case of a wireless communications link, the interface may comprise one of: a receiver for receipt of wireless signals from the host; a transmitter for sending wireless signals to the host; and a transceiver for receiving wireless signals from, and sending wireless signals to, the host. For example, in the case of a wired communications link, the interface may comprise one or both of: a male connector for connection with a female connector on or connected to the host; and a female connector for connection with a male connector on or connected to the host.

The communications link is preferably suitable for one or more of the following functions: for downloading software from the host to the system; for downloading information from the host to the system; for charging the system; for uploading information from the system to the host; and for registering the system with the host. If the host is Internet-enabled, those functions may take place whilst the host is accessing an Internet site, or separately from the host accessing an Internet site.

Preferably, the electrical hardware is programmable by software. The software may be downloadable from the host via the communications link.

Preferably the electrical hardware comprises a sensor to detect air flow indicative of a user taking a puff. The sensor may be an electro-mechanical device. Alternatively, the sensor may be any of: a mechanical device, an optical device, an opto-mechanical device and a micro electro-mechanical-systems (MEMS) based sensor. In that case, preferably the electrical hardware is arranged to provide an electric current pulse to the at least one heating element when the sensor senses a user taking a puff. Preferably the time-period of the electric current pulse is pre-set, depending on the amount of aerosol desired. The electrical hardware is preferably programmable for this purpose.

Alternatively, the electrical hardware may comprise a manually operable switch for a user to initiate a puff. In that case, preferably the electrical hardware is arranged to provide an electric current pulse to the at least one heating element when the user initiates a puff. Preferably, the time period of the electric current pulse is pre-set depending on the amount of aerosol desired. The electrical hardware is preferably programmable for this purpose.

The electrically heated smoking system may further comprise a puff indicator for indicating when the heating element is activated. In the embodiment in which the electrical hardware comprises a sensor to detect air flow indicative of a user taking a puff, the indicator may be activated when the sensor senses air flow indicative of the user taking a puff. In the embodiment in which the electrical hardware comprises a manually operable switch, the indicator may be activated by the switch.

The electrically heated smoking system may further comprise a housing for receiving the aerosol-forming substrate and designed to be grasped by a user. The housing may comprise a shell and a replaceable mouthpiece.

BRIEF DESCRIPTION OF THE DRAWINGS

Many objects and advantages of the present invention will be apparent to those skilled in the art when this specification is read in conjunction with the appended drawings of an exemplary embodiment wherein like reference numerals have been applied to like elements and wherein.

DETAILED DESCRIPTION OF THE PREFERRED EMBODIMENT

Figure 1:
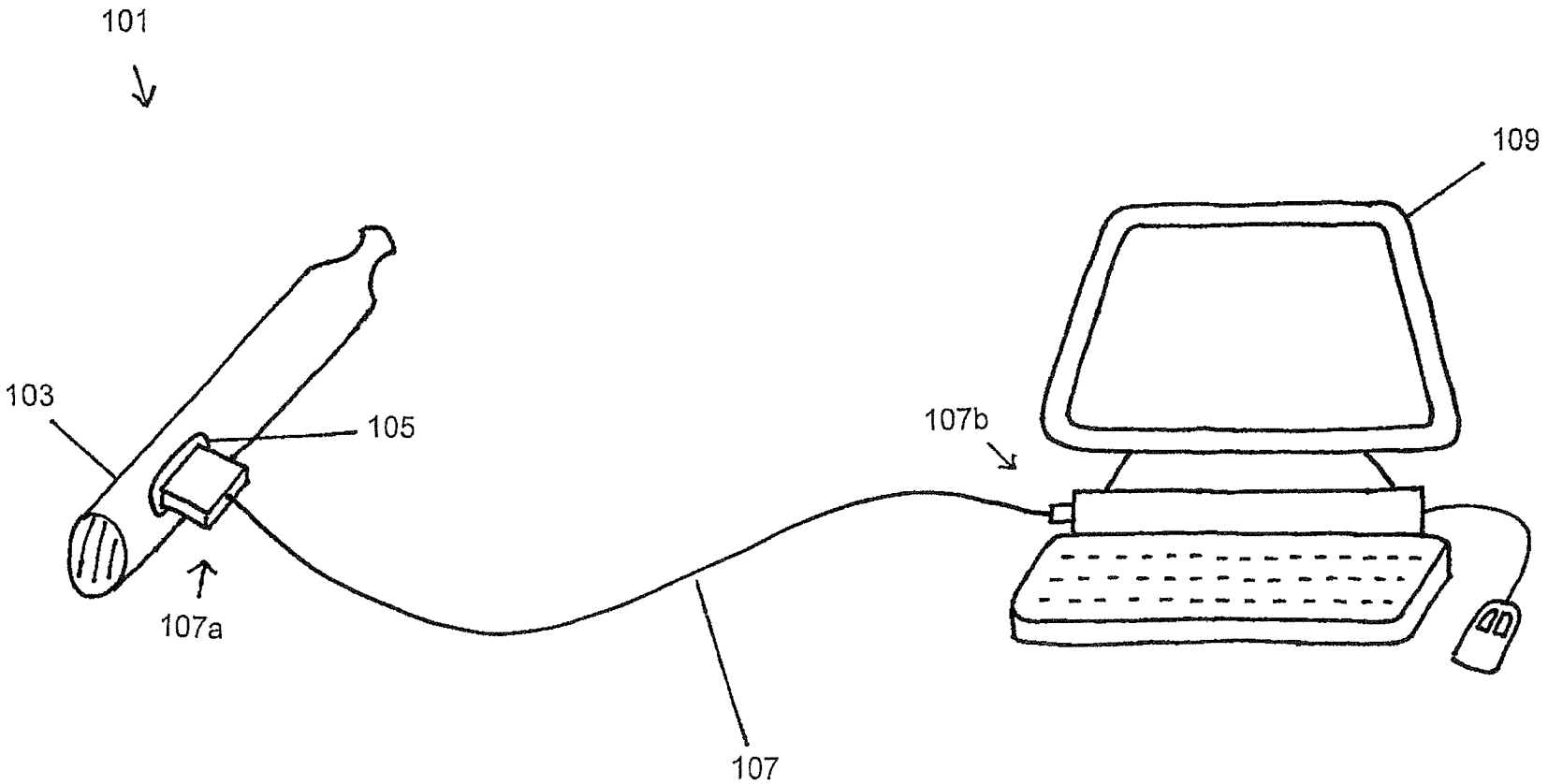
FIG. 1 depicts an embodiment of the electrically heated smoking system connected to a host via a USB link.
Figure 2:
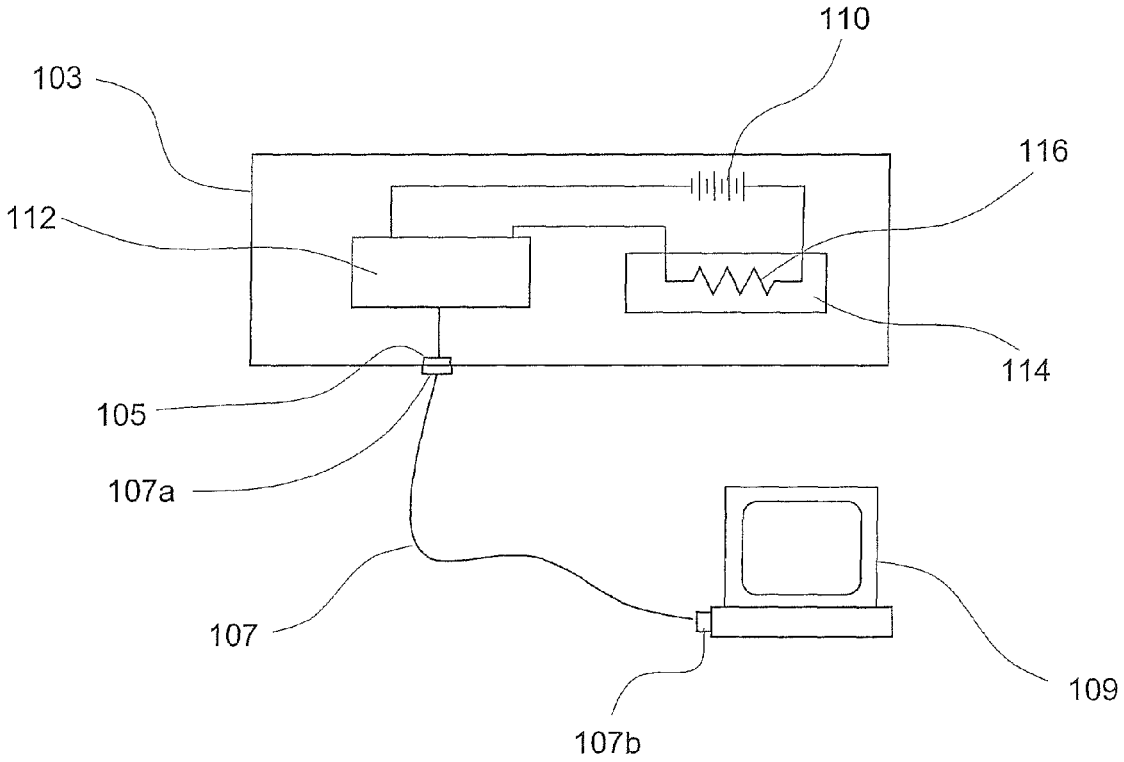
FIG. 2 is a schematic illustration of the electrically heated smoking system of FIG. 1.

Referring to FIG. 1, in this embodiment, the electrically heated smoking system in the form of device 101 comprises a housing 103 containing a power supply 110 (see FIG. 2) in the form, for example, of a Lithium-ion battery, electrically connected to electrical hardware 112 in the form, for example, of a printed circuit board. In addition, an aerosol-forming substrate 114, which may be in the form of a tobacco plug may be contained in the housing 103. A heating element 116, which may be in the form of a heating blade, for example, in contact with the tobacco plug, may also be electrically connected with the power supply 110 and the electrical hardware 112. The housing 103 may also include an interface 105, which may be in the form of a USB socket, for receiving a first end 107*a* of a communications link 107 that may be in the form of a USB connector. A second end 107*b* of the communications link 107 may be plugged into a host 109, that may be in the form of Personal Computer (PC). The PC 109 is Internet-enabled.

The hardware in the device 101 comprises a limited set of software-supporting components. This allows the device itself to remain relatively simple in terms of memory and processing power. Extended capabilities for the device (to be discussed below) are hosted on the Internet-enabled PC 109 and transferred to and from the device 101 as required. Thus, the device may be connected, via the PC 109, to one or more approved Internet sites. In this embodiment, the link is a USB link which provides bi-directional communication and can also provide power to the device.

A number of extended capabilities are possible, as follows:

Firstly, software may be downloaded from the PC to the device. The software may include updated versions of software, as software develops, or to fix a specific bug. Alternatively, or in addition, the software may include additional features, which are, for example downloadable after payment by the user. This removes the need for the device to be returned to the supplier or manufacturer for software downloads. This capability is not limited to the device 101 and PC 109 of FIG. 1, but may apply to any electrically heated smoking system according to the invention.

Secondly, information may be downloaded from the PC to the device. For example, a user may personalize the device by specifying information such as a maximum number of puffs permitted per time period, and a minimum interval between puffs. This may assist with managing smoking behaviour. Alternatively, or in addition, the user may specify the brand of tobacco plug being used and control parameters can then be downloaded from the PC to the device, to optimize the smoking experience for that brand. Alternatively, or in addition, further features could be downloaded, for example auto-shutdown after a selected period of inactivity. This could be used as a security feature to prevent a lost or stolen device being used without authorisation. Again, this capability is not limited to the device 101 and PC 109 of FIG. 1, but may apply to any electrically heated smoking system according to the invention. If the user specifies a brand, this will be the brand of the particular aerosol-forming substrate being used.

Thirdly, the PC may provide electrical power to the device. For example, if the device contains a rechargeable battery or other chargeable circuitry, the connection could be used to re-charge the battery or circuitry. This may be the case in the FIG. 1 embodiment. Or, if the device does not contain an internal power source, the PC may provide electrical power to the device while the device is being used by a smoker. This will mean that it is necessary to have the device and PC connected, while the device is being used. This capability is not limited to the device 101 and PC 109 of FIG. 1, but may apply to any electrically heated smoking system according to the invention.

Fourthly, information may be uploaded from the device to the PC. For example, for acquiring smoking behaviour information during clinical trials, the user can simply connect the device to the PC to upload data. This would automate much of the data collection and analysis, speeding up the process whilst minimising the data errors that are inherent in manual systems. Or, for assistance with managing smoking behaviour, the user could upload smoking behaviour information, to track the data and note improvements. Again, this capability is not limited to the device 101 and PC 109 of FIG. 1, but may apply to any electrically heated smoking system according to the invention.

Fifthly, the connection could be used for a user to register the device with an Internet application supported on the PC. For example, this could be used as a security feature if the device is supplied by post, so that the device is only enabled after registration. This capability is not limited to the device 101 and PC 109 of FIG. 1, but may apply to any electrically heated smoking system according to the invention.

Other possible capabilities include, but are not limited to:

Pay-as-you-smoke functionality. For example the user buys daily or weekly or monthly smoking time from the Internet application supported on the PC, or the user obtains smoking time credits based on cigarettes and other smoking articles bought via the Internet application.

The device could be pre-loaded with credit which could be used to buy items, such as smoking articles, from the Internet application.

The Internet application hosted on the PC could be an approved support group Internet site for assistance with smoking cessation. The Internet application could offer a controlled amount of smoking time whilst monitoring the smoking behaviour.

If the device operates with separate smoking articles, the Internet application could recommend the most suitable smoking articles for the device, when the device is connected to the PC. Or similarly, for any type of aerosol-forming substrate, the Internet application could recommend the most suitable brands for the device.

If the device operates with separate smoking articles, the Internet application could monitor usage and automatically pre-order additional smoking articles when required. Or similarly, for any type of aerosol-forming substrate, the Internet application could monitor usage and pre-order aerosol-forming substrate when appropriate.

The Internet application could monitor usage of the device and recommend maintenance at appropriate junctures.

The device could include additional functionality, such as an MP3 player, satellite navigation and so forth, which could be downloaded to the device from the PC.

Clearly, these capabilities are not limited to the device 101 and PC 109 of FIG. 1, but may apply to any electrically heated smoking system according to the invention.

Thus, a large number of extended capabilities may be provided, not limited to those listed above. The interface for connection via a communications link to the host, allows the electrically heated smoking system itself to be kept relatively simple and low-cost to manufacture, whilst providing capability for advanced functionality via the communications link.

The summary, abstract, and other parts of this specification are intended to be illustrative, but not limiting. Accordingly, it is intended that all parts of this specification should be taken as a whole and not interpreted in any way to limit the breadth or generality of other parts of this specification.

It will be apparent to those skilled in the art that various modifications, variations, substitutions, and equivalents exist for various features described herein which do not depart from the spirit and scope of the invention. Accordingly, it is expressly intended that all such modifications, variations, substitutions, and equivalents which fall within the spirit and scope of the invention as defined by the appended claims be embraced thereby.

What is claimed is:

1. An electrically heated smoking system for receiving an aerosol-forming substrate, the system comprising:

a substrate;

at least one heating element for heating the substrate to form an aerosol;

a power supply connected to the at least one heating element and operable to supply power thereto;

programmable electrical hardware connected to the power supply and the at least one heating element, the electrical hardware being configured to communicate over a bidirectional communications link with a remote host and control the at least one heating element in heating the substrate based on the control parameters received over the communications link.

2. The electrically heated smoking system according to claim 1, comprising:

an interface configured to establish the communications link between the electrical hardware and a remote host.

3. The electrically heated smoking system according to claim 2, wherein the interface is configured to establish at least one of a wired or wireless link between the electrical hardware and the remote host.

4. The electrically heated smoking system according to claim 1, wherein based on the received control parameters, the electrical hardware is configured to automatically shutdown after a selected period of inactivity.

5. The electrically heated smoking system according to claim 1, wherein based on the received control parameters, the electrical hardware is configured to permit a maximum number of puffs per time period.

6. The electrically heated smoking system according to claim 1, wherein based on the received control parameters, the electrical hardware is configured to provide a minimum interval between puffs.

7. The electrically heated smoking system according to claim 1, wherein the electrical hardware is configured to store smoking behavior information associated with controlling the at least one heating element to heat the substrate.

8. The electrically heated smoking system according to claim 1, wherein the electrical hardware is configured to control the power supply based on the control parameters received over the communications link.

* * * * *